US010712081B2

(12) United States Patent
Na

(10) Patent No.: US 10,712,081 B2
(45) Date of Patent: Jul. 14, 2020

(54) SMART REPOSITORY

(71) Applicant: SUNGKANG EGS CO., LTD, Seoul (KR)

(72) Inventor: Jung-Hwan Na, Incheon (KR)

(73) Assignee: SUNKANG EGS CO., LTD, Seoul (KR)

( * ) Notice: Subject to any disclaimer, the term of this patent is extended or adjusted under 35 U.S.C. 154(b) by 0 days.

(21) Appl. No.: 16/302,894

(22) PCT Filed: Oct. 6, 2016

(86) PCT No.: PCT/KR2016/011159
§ 371 (c)(1),
(2) Date: Nov. 19, 2018

(87) PCT Pub. No.: WO2017/204417
PCT Pub. Date: Nov. 30, 2017

(65) Prior Publication Data

US 2019/0316836 A1 Oct. 17, 2019

(30) Foreign Application Priority Data

May 25, 2016 (KR) ..... 10-2016-0063885

(51) Int. Cl.
*A47B 96/04* (2006.01)
*F25D 25/00* (2006.01)
(Continued)

(52) U.S. Cl.
CPC ..... *F25D 25/005* (2013.01); *F25D 23/04* (2013.01); *F25D 25/04* (2013.01); *F25D 29/005* (2013.01); *F25D 2400/361* (2013.01)

(58) Field of Classification Search
CPC ..... A47B 63/067; B65G 1/127
See application file for complete search history.

(56) References Cited

U.S. PATENT DOCUMENTS 4,676,560 A * 6/1987 Schmitz ..... B65G 1/127 312/268
4,948,208 A * 8/1990 Schubert ..... F16C 29/00 312/334.16

(Continued)

FOREIGN PATENT DOCUMENTS

CH 310773 A * 11/1955 ..... A47B 63/067
CN 202160969 U 3/2012

(Continued)

*Primary Examiner* — Matthew W Ing
(74) *Attorney, Agent, or Firm* — Schmeiser, Olsen & Watts LLP

(57) ABSTRACT

The present invention relates to a smart repository that can be used as a refrigerator or the like, the smart repository being characterized by comprising: a repository body having a door installed in an entrance/exit formed in a side surface thereof, the repository body containing an outer column that faces the entrance/exit and an inner column that communicates with the outer column through the upper and lower end portions thereof; multiple storing boxes provided to be contained and stacked inside the outer and inner columns; a plurality of vertical driving devices installed on the outer and inner columns, respectively, and driven so as to lift/lower the multiple storing boxes; an imaging portion comprising a plurality of push means for moving a box on the upper end portion of the inner column toward the outer column and moving a box on the lower end portion of the outer column toward the inner column, the imaging portion being configured to take an image of a to-be-stored object introduced through the door; a display portion for displaying images that correspond to the multiple storing boxes one-to-one; and a control portion configured such that the taken images are matched with a storing box positioned in the entrance/exit, stored, and displayed. Accordingly, the content stored in each storing box is imaged and displayed to the (Continued)

outside such that the contents stored in the repository can be easily recognized at a glance.

4 Claims, 6 Drawing Sheets

(51) Int. Cl.
*F25D 23/04* (2006.01)
*F25D 25/04* (2006.01)
*F25D 29/00* (2006.01)

(56) References Cited

U.S. PATENT DOCUMENTS

| | | | | | |
|---|---|---|---|---|---|
| 6,854,815 | B1 * | 2/2005 | Smith | A47B 49/008 | 198/802 |
| 8,733,860 | B1 * | 5/2014 | Burke | A47F 5/03 | 312/134 |
| 9,643,782 | B1 * | 5/2017 | Hall | B65G 1/127 | |
| 2006/0238084 | A1 * | 10/2006 | Golani | B65G 1/127 | 312/268 |
| 2008/0003083 | A1 * | 1/2008 | Solomon | B65G 1/127 | 414/237 |
| 2014/0300265 | A1 * | 10/2014 | Lee | H04N 7/181 | 312/405.1 |
| 2017/0290454 | A1 * | 10/2017 | Hall | B65G 1/127 | |

FOREIGN PATENT DOCUMENTS

| | | | | |
|---|---|---|---|---|
| DE | 19855484 | A1 * | 6/2000 | B65G 1/127 |
| JP | 2003090661 | A | 3/2003 | |
| JP | 1020150128901 | | 11/2015 | |
| KR | 1020120116207 | A | 10/2012 | |

* cited by examiner

100

SMART REPOSITORY

TECHNICAL FIELD

The present invention relates generally to a repository that can be used as a refrigerator. More particularly, the present invention relates to a smart repository, which is capable of checking and displaying storage periods of contents such as foods and food ingredients, and is capable of preventing the contents from going bad or being spoiled due to sudden change in the internal temperature when the door is opened and closed.

BACKGROUND ART

Although a refrigerator is a convenient storage medium for storing contents such as foods and food ingredients for a long period of time, from the user's point of view, it is not easy to remember where food is stored in the refrigerator, when the food is stored, and what the food is stored in, and it is difficult to organize contents because there is no information about what someone else has stored. In addition, there was an inconvenience that to find out what kinds of foods are contained in plastic bags in a refrigerator, the plastic bags should be opened individually.

Meanwhile, in order to solve the above problems, in the document of Korean Patent No. 10-1237641, there has been disclosed a "Refrigerator having a date display store unit" (registered Feb. 20, 2013), in which a display device capable of entering and displaying a storage date for each storage space of a refrigerator. However, it is disadvantageous in that since the display device is provided in the refrigerator, a user must open a door every time to check it.

Further, in order to solve the above problem, in the document of Korean Utility Model Registration No. 20-0290777, there has been disclosed an "Apparatus for managing and displaying expiration date of things in refrigerator" (registered Sep. 17, 2002), in which items are identified through barcode input, and the expiration date is displayed and counted to generate an alarm sound. However, it is disadvantageous in that it is not easy to adopt the apparatus because a separate input means such as a barcode reader is required, and it does not provide information about what item has reached the expiration date and where the item is.

DISCLOSURE

Technical Problem

Accordingly, the present invention has been made keeping in mind the above problems occurring in the prior art, and an object of the present invention is to provide a smart repository, which is improved such that information about stored contents and storage period are easily determined.

Technical Solution

In order to accomplish the above object, the present invention provides a smart repository including: a repository body openably provided with a door at an entrance formed in a side surface thereof, and provided thereinside with an outer column facing the entrance, and at least one inner column arranged in parallel with the outer column to communicate with the outer column through upper and lower end portions thereof; a plurality of storing boxes accommodated in the outer column and the inner column of the repository body, and arranged on top of each other; a plurality of vertical driving devices provided in the outer column and the inner column, respectively, and configured to be driven to move the plurality of storing boxes up and down in the corresponding column; a plurality of pushing means configured to move a storing box disposed at the upper end portion of the inner column toward the outer column, and move a storing box disposed at the lower end portion of the outer column toward the inner column; an imaging unit provided at an upper portion of the entrance of the repository body, and configured to take an image of an object introduced through the door to be stored; a display unit provided on an outer side surface of the repository body, and configured to simultaneously display a plurality of images corresponding one-to-one to the plurality of storing boxes; and a control unit configured such that an image taken by the imaging unit is stored and displayed by matching the image with a storing box disposed at the entrance.

Here, the smart repository may further include an input unit provided at the entrance side of the repository body such that a storage period of the object is input therethrough, wherein the control unit is configured such that the image is displayed by adjusting a background color of the image according to a remaining period of the storage period according to lapse of time.

The smart repository may further include a communication unit configured to mediate wireless communication with an outside, wherein the control unit is configured to transfer an image displayed through the display unit to a user's portable terminal through the communication unit.

Further, the pushing means may use a repulsive force between a magnet provided on a surface of the storing box and a magnet provided on an inner surface of the repository body corresponding thereto.

Further, the plurality of storing boxes arranged on top of each other in the outer column and the inner column may use a repulsive force between magnets provided on upper and lower surfaces of each of the storing boxes to correspond to each other, so as to minimize a frictional resistance between upper and lower storing boxes.

Advantageous Effects

According to the smart repository of the present invention configured as described above, it is advantageous in that the contents stored in each storing box are imaged and displayed outside so that the contents stored in the storage can be easily determined at a glance.

In particular, it is advantageous in that the remaining period of the storage period of the contents can be easily noticeable by changing the background color of the displayed image, whereby it is possible to solve the problem of discarding food after the storage period.

It is further advantageous in that since the display screen of the contents can be checked through the external portable terminal, it is possible to solve the problem of duplicate purchases at a market.

It is further advantageous in that the door for opening and closing the repository is formed only on one side of the repository body so that the temperature of the inside of the repository can be maintained at a constant temperature like a crypt, whereby it can greatly contribute to prevention a conventionally occurring phenomenon in which contents go bad or are spoiled due to sudden change in the internal temperature when the door is opened and closed.

BEST MODE

Figure 1:
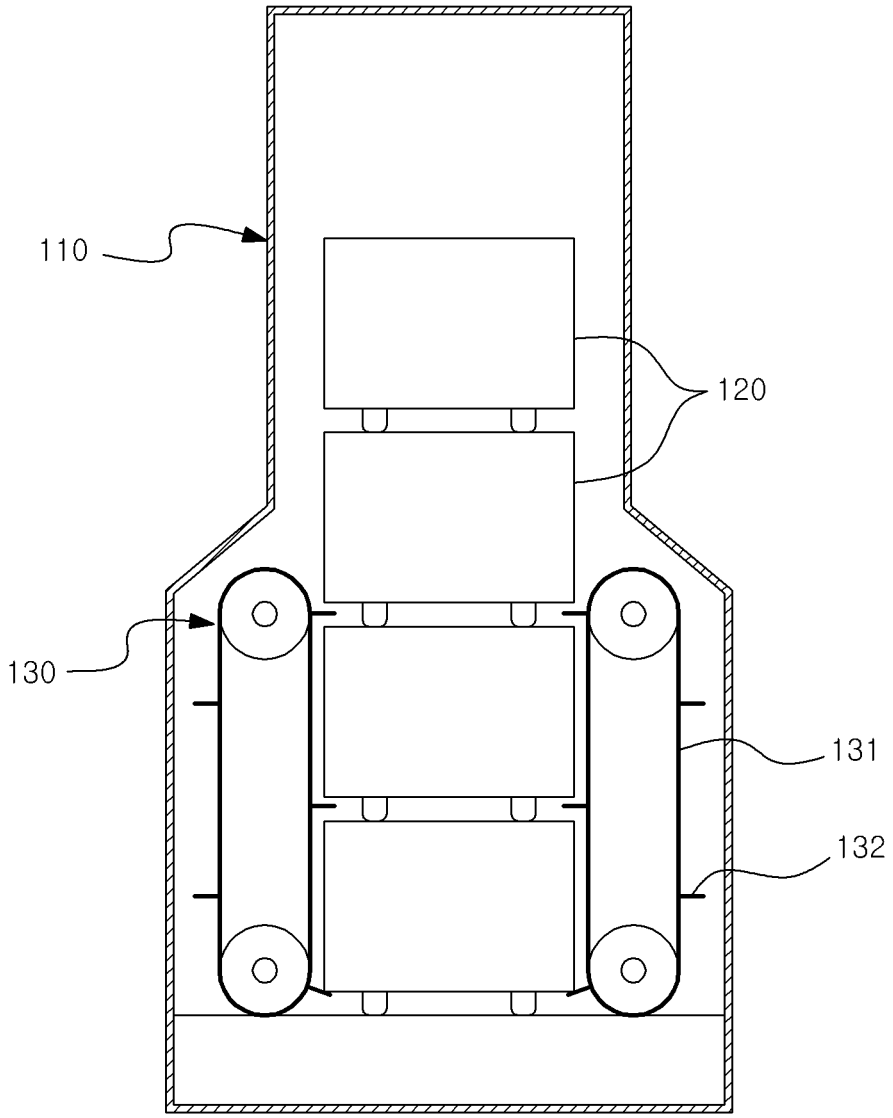
FIGS. 1 and 2 are perspective views showing a smart repository according to an embodiment of the present invention when viewed from front and side of the smart repository.
Figure 2:
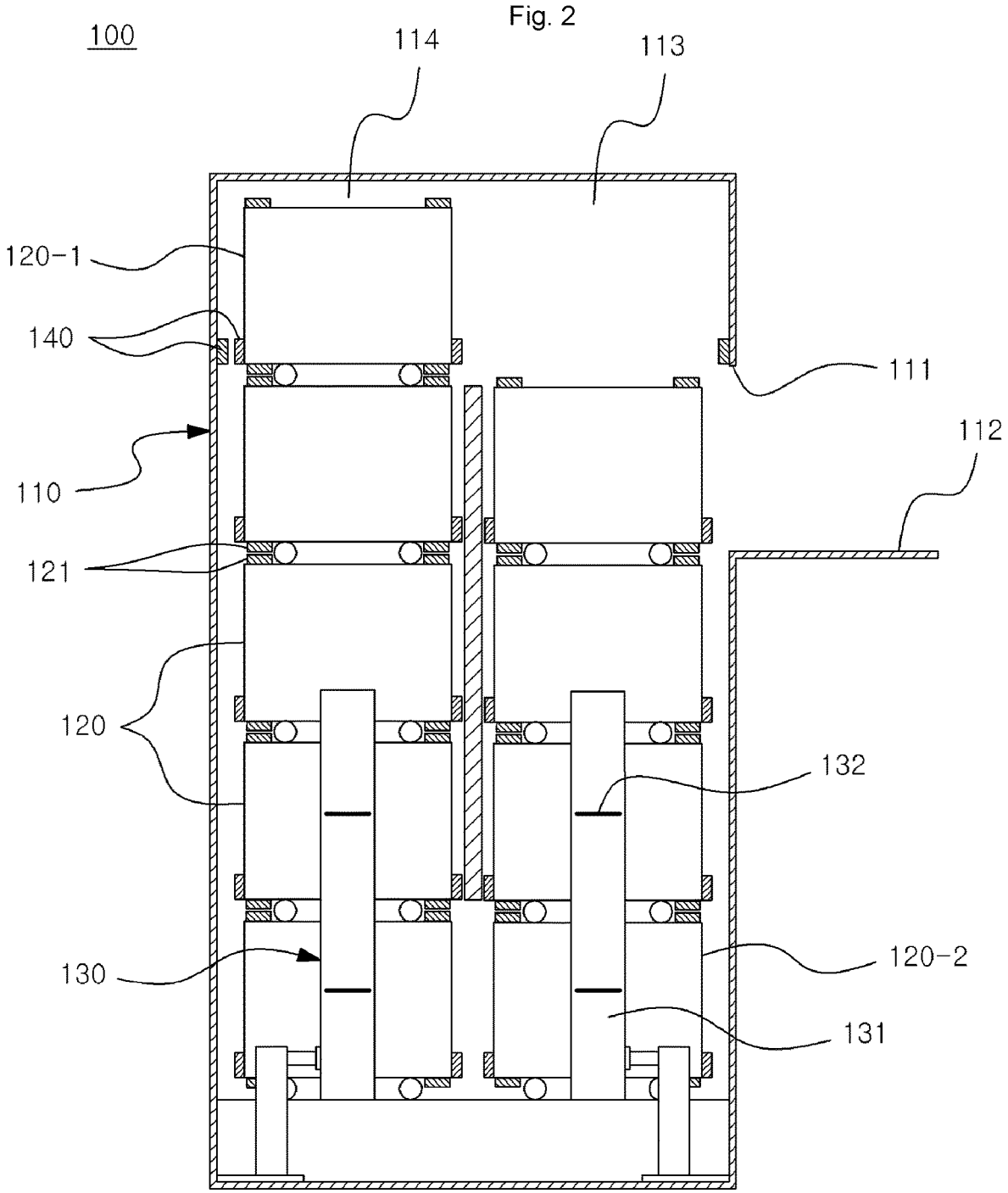

As shown in FIGS. 1 and 2, a smart repository 100 according to an embodiment of the present invention includes: a repository body 110 provided with an entrance 111 in a side surface thereof; a plurality of storing boxes 120 arranged on top of each other in the repository body 110; and vertical driving devices 130 for driving the plurality of storing boxes to be moved up and down.

The repository body 110 is provided with a door 112 to open and close the entrance 111, and thereinside, an outer column 113 facing the entrance 111 and an inner column 114 adjacent to the outer column are provided. The outer column 113 and the inner column 114 communicate with each other through upper and lower end portions thereof.

The vertical driving devices 130 are provided in the columns 113 and 114, respectively, so as to be driven to move up and down the plurality of storing boxes 120 arranged on top of each other in the corresponding column. To achieve this, stop protrusions 132 may be provided on a surface of a conveyor belt 131 to support bottoms of the storing boxes 120. Alternatively, although not shown, the surface of the conveyor belt 131 may be formed in a gear shape and corresponding gears may be formed on the left and right sides of the storing boxes 120 so as to be engaged with each other.

Here, a storing box 120-1 disposed at the upper end portion of the inner column 114 is configured to slide toward the upper end portion of the outer column 113 by using the same polarity of magnets 140 provided on a side of the storing box and the corresponding inner side of the repository body 110. To achieve this, it is preferable that the upper end portions of the columns 113 and 114 are formed to be inclined toward the outer column 113 side. Meanwhile, as pushing means for moving the storing box 120-1, an electromagnet that generates magnetic force by power application, an air cylinder, a solenoid, and the like may be used instead of the magnets 140.

The magnetic force by the magnets is also generated between the upper and lower storing boxes 120, thereby contributing to minimizing the friction between the upper and lower storing boxes (see reference numeral 121).

Also, a storing box 120-2 disposed at the lower end portion of the outer column 113 can be moved toward the inner column 114 by the pushing means such as the magnets 140.

Meanwhile, the smart repository configured as described above, as shown in FIG. 3, includes: an imaging unit 150 provided at an upper portion of the entrance 111 of the repository body; a display unit 160 configured to simultaneously display contents stored in each storing box 120; and an input unit 170 configured such that a storage period, that is, the total remaining days available (e.g., 3 days, 7 days, 15 days, etc.) from the time of storage, of the contents stored in the storing box 120 is input therethrough.

Accordingly, when the user selects an empty one of the storage boxes 120 displayed through the display unit 160 (S11 of FIG. 5), a control unit (reference numeral 181 of FIG. 4) controls a driving unit 182 to drive the vertical driving devices (reference numeral 130 of FIG. 2), thereby moving the corresponding storing box 120 to the entrance 111.

Then, the user opens the door 112 to place the contents to be stored on the upper surface of the door 112 and the contents are imaged by the imaging unit 150 with the input unit 170 in a button input manner. Next, the available period of the contents or the storable period, i.e., the storage period, is input through the input unit 170, and after the contents are put in the storing box 120, the door 112 is closed to complete storage (S12).

Figure 3:
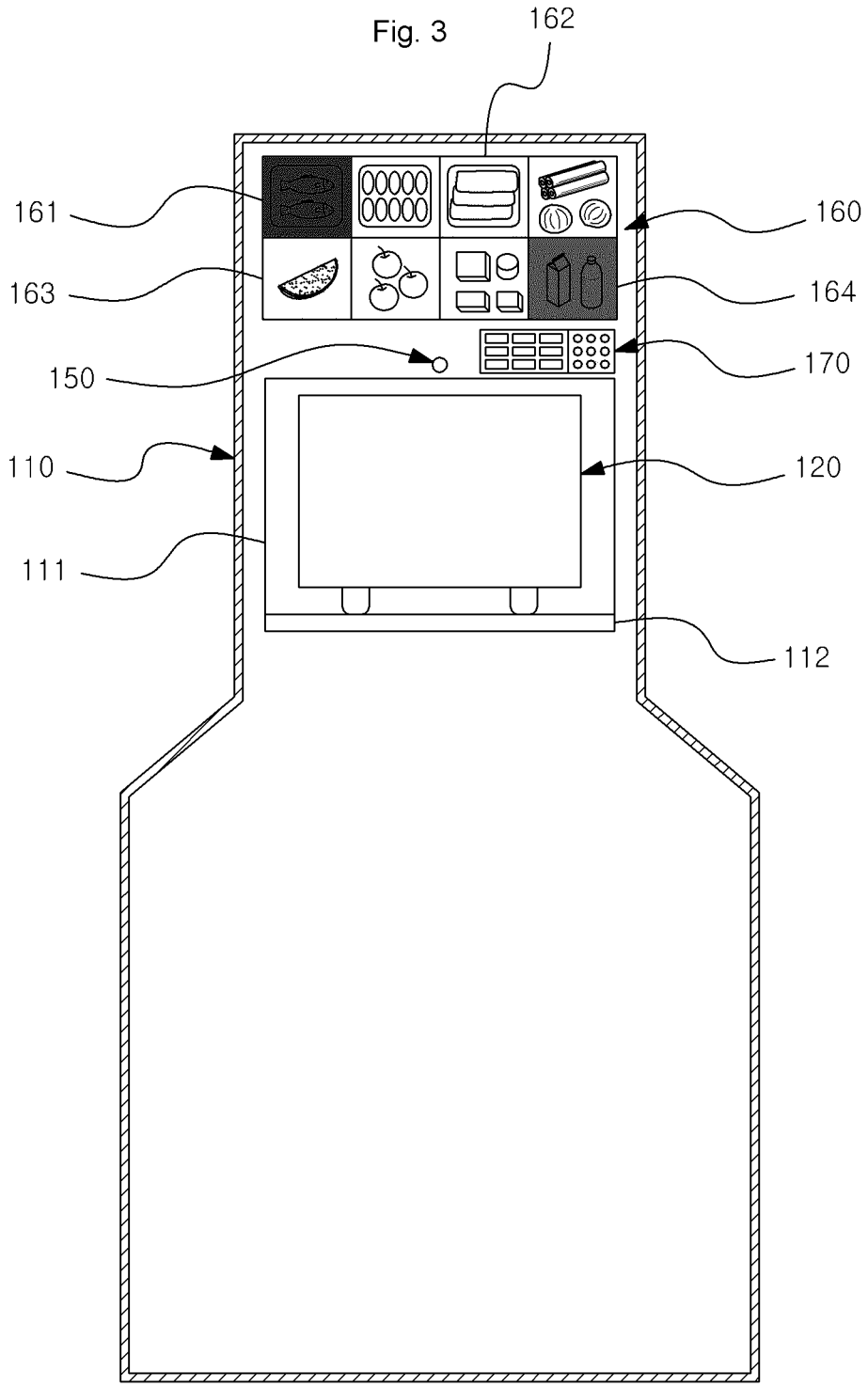
FIG. 3 is a front view showing a state where a door of the smart repository of FIG. 1 is opened.

Accordingly, the control unit (reference numeral 181 of FIG. 4) is configured to store the image of the contents in a storage unit 183 and to allow the image to be displayed through the display unit 160 (see FIG. 3).

As described above, since the contents stored in all the storing boxes 120 are displayed through the display unit 160, the user can check all the contents stored in the repository without checking the inside of the storing boxes individually. Here, it is advantageous in that since the displayed contents are kept sealed in different storing boxes 120, it is possible to prevent odors from mixing with each other, thereby maintaining the original flavor of the contents.

Meanwhile, the display unit 160 may be configured in the form of a touch panel so that the user can select a necessary function such as moving the desired storing box 120 to the entrance 111 by simply touching the corresponding screen of the display unit 160 without a separate input unit.

Figure 6:
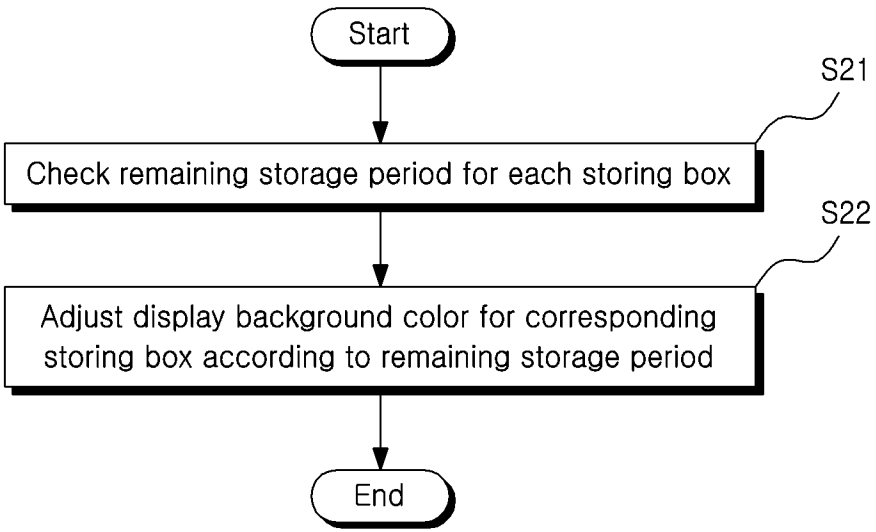
FIG. 6 is a flow chart showing how to display contents stored in the smart repository of FIG. 1.

The control unit (reference numeral 181 of FIG. 4) is configured to store the storage period inputted by the user along with the image capturing when storing the contents in the storage unit 183 and check the lapse of time through the timer to check the remaining period of the storage period (S21 of FIG. 6). Thereby, for the contents whose remaining period is short and the storing box 120, the background color thereof is adjusted and displayed as a warning message (S22). For example, referring to FIG. 3, in the image of fish 161 with the remaining period 1 day, the background color thereof is red; in the images of bacon 162 and watermelon with the remaining period 2 days, the background color thereof is yellow; in the image of milk with the remaining period 3 days, the background color thereof is blue; and in the images of the remaining contents with the remaining period more than 3 days, the background color thereof is not adjusted.

Accordingly, any user can identify and consume the items to be used at a glance among the foods stored, so it is possible to solve the problem of discarding food.

Figure 4:
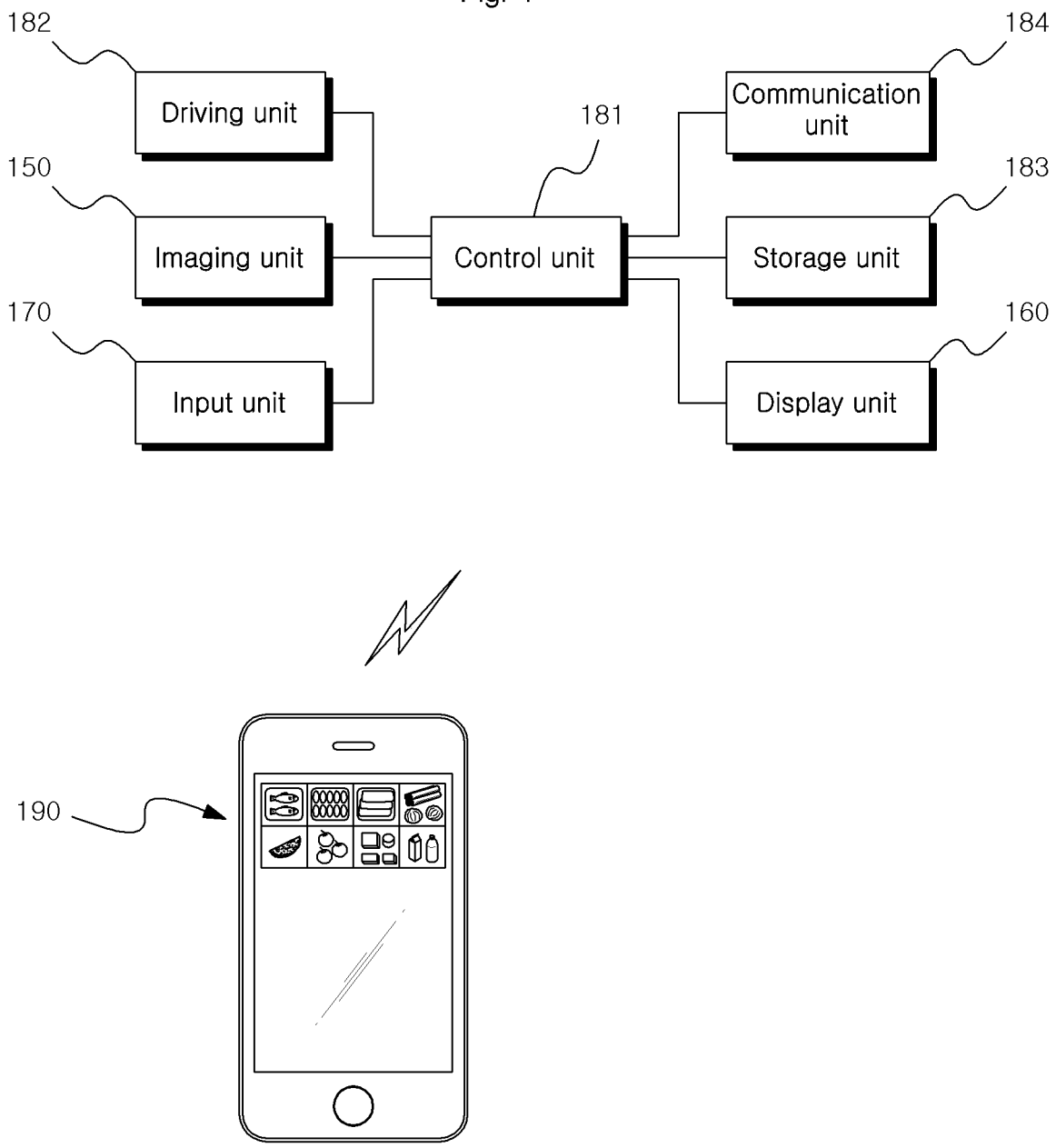
FIG. 4 is a control block diagram applied to the smart repository of FIG. 1.
Figure 5:
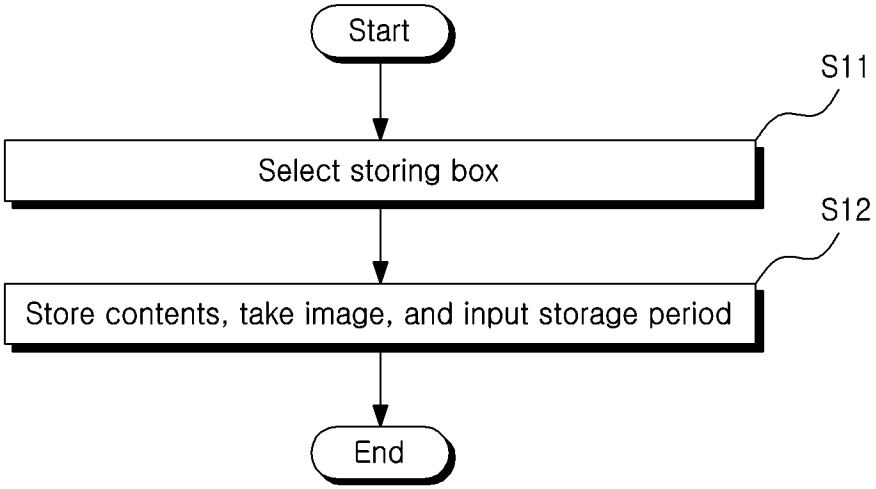
FIG. 5 is a flow chart showing how to store contents in the smart repository of FIG. 1.

Further, referring to FIG. 4, the control unit 181 transfers the image displayed through the display unit 160 to a user's portable terminal 190 through a communication unit 184. To achieve this, in the user's portable terminal 190, an application that enables data transmission/reception and screen output through wireless communication with the smart repository 100 may be installed.

According to this, when the user goes to a market, the user can check the image (see reference numeral 160 of FIG. 3) displayed on the smart repository 100 through the portable terminal 190 by executing the application, whereby it is possible to prevent duplicate a purchase for a product that has already been purchased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

In addition, the scope of the present invention is defined only by the accompanying claims and their equivalents.

The invention claimed is:

1. A smart repository comprising:

a repository body openably provided with a door at an entrance formed in a side surface thereof, and provided thereinside with an outer column facing the entrance, and at least one inner column arranged in parallel with the outer column to communicate with the outer column through upper and lower end portions thereof;

a plurality of storing boxes accommodated in the outer column and the inner column of the repository body, and arranged on top of each other;

a plurality of vertical driving devices provided in the outer column and the inner column, respectively, and configured to be driven to move the plurality of storing boxes up and down in the corresponding column;

a plurality of pushing means configured to move a storing box disposed at the upper end portion of the inner column toward the outer column, and move a storing box disposed at the lower end portion of the outer column toward the inner column;

an imaging unit provided at an upper portion of the entrance of the repository body, and configured to take an image of an object introduced through the door to be stored;

a display unit provided on an outer side surface of the repository body, and configured to simultaneously display a plurality of images corresponding one-to-one to the plurality of storing boxes;

a control unit configured such that an image taken by the imaging unit is stored and displayed by matching the image with a storing box disposed at the entrance; and further comprising an input unit provided at the entrance side of the repository body such that a storage period of the object is input therethrough, wherein the control unit is configured such that the image is displayed by adjusting a background color of the image according to a remaining period of the storage period according to lapse of time.

2. The smart repository of claim 1, further comprising a communication unit configured to mediate wireless communication with an outside, wherein the control unit is configured to transfer an image displayed through the display unit to a user's portable terminal through the communication unit.

3. The smart repository of claim 1, wherein the pushing means uses a repulsive force between a magnet provided on a surface of the storing box and a magnet provided on an inner surface of the repository body corresponding thereto.

4. A smart repository comprising:

a repository body openably provided with a door at an entrance formed in a side surface thereof, and provided thereinside with an outer column facing the entrance, and at least one inner column arranged in parallel with the outer column to communicate with the outer column through upper and lower end portions thereof;

a plurality of storing boxes accommodated in the outer column and the inner column of the repository body, and arranged on top of each other;

a plurality of vertical driving devices provided in the outer column and the inner column, respectively, and configured to be driven to move the plurality of storing boxes up and down in the corresponding column;

a plurality of pushing means configured to move a storing box disposed at the upper end portion of the inner column toward the outer column, and move a storing box disposed at the lower end portion of the outer column toward the inner column;

an imaging unit provided at an upper portion of the entrance of the repository body, and configured to take an image of an object introduced through the door to be stored;

a display unit provided on an outer side surface of the repository body, and configured to simultaneously display a plurality of images corresponding one-to-one to the plurality of storing boxes;

a control unit configured such that an image taken by the imaging unit is stored and displayed by matching the image with a storing box disposed at the entrance; and wherein the plurality of storing boxes arranged on top of each other in the outer column and the inner column use a repulsive force between magnets provided on upper and lower surfaces of each of the storing boxes to correspond to each other, so as to minimize a frictional resistance between upper and lower storing boxes.

* * * * *